United States Patent [19]

Ryan

[11] 4,135,604

[45] Jan. 23, 1979

[54] VANITY STORING STEP

[76] Inventor: Francis Ryan, 50 Watson Crescent, Brampton, Canada, L6W 1E7

[21] Appl. No.: 869,225

[22] Filed: Feb. 6, 1978

[51] Int. Cl.[2] ..... E06C 9/00; A47B 43/00; A47B 83/00

[52] U.S. Cl. ..... 182/91; 182/129; 182/33; 312/235 R

[58] Field of Search ..... 182/129, 91, 33, 77; 312/235 R

[56] References Cited

U.S. PATENT DOCUMENTS

| | | | |
|---|---|---|---|
| 2,087,695 | 7/1937 | Miller | 312/235 R |
| 2,570,865 | 10/1951 | Sabo | 182/91 |
| 2,599,529 | 6/1952 | Harvey | 182/91 |
| 2,881,040 | 4/1959 | Hartridge | 312/235 R |
| 3,030,166 | 4/1962 | Richards | 312/235 R |
| 3,136,386 | 6/1964 | Horvath | 182/91 |
| 3,481,429 | 12/1969 | Gaede | 312/235 R |
| 3,756,678 | 9/1973 | Klopfenstein | 182/91 |

*Primary Examiner*—Reinaldo P. Machado
*Attorney, Agent, or Firm*—Robert D. Farkas

[57] ABSTRACT

A vanity storing step utilizes an L shaped plate, one leg of which is secured to the interior floor portion of a vanity carrying a sink, the other leg of which extends upwardly towards the base of the sink. A pair of plates are secured extending transverse to the upwardly extending leg having the uppermost edge adjacent to the floor of the sink, carrying a pair of pivot rods therein. The pivot rods are secured to a pair of beams to which are attached a pair of legs and a stair tread straddling the beams. When not in use, the stair tread is pivoted upwardly and inwardly below the sink floor to a stored position within the vanity carrying the sink. In a use position, the legs have their lowermost portions reside on the floor in front of the cabinet such that the stair tread is disposed in a horizontal position above the floor and adjacent the front of the vanity, thereby providing convenient elevation for children utilizing the sink.

10 Claims, 2 Drawing Figures

VANITY STORING STEP

BACKGROUND OF THE INVENTION

1. The Field of the Invention

This invention relates to step devices and more particularly to that class of apparatus adapted to be holdably positioned within an enclosure and disposed in a use position adjacent said enclosure having at least a portion thereof supported by a portion of the floor adjacent the enclosure.

2. Description of the Prior Art

The prior art abounds with foldable, collapsible, horizontal supporting surfaces of a wide variety. U.S. Pat. No. 2,625,984 issued Jan. 20, 1953 to E. W. Schweickert teaches a seat member and a foot stool member, both angularly disposed and fixedly secured to a elongated plate, the lowermost end of the plate is pivotably secured to an exterior surface of a bar or counter such that when the seat portion thereof is disposed outwardly from the bar the apparatus may be utilized in a cantilever fashion having the bar of counter providing total support for the apparatus. Though the Schweickert teaching permits a seat and foot rest portion to be sensibly concealed within the bar or counter when not in a use condition, the apparatus requires extremely sturdy mounting devices because of the cantilever type construction in which the seat portion is disposed at the end of a long fulcrum arm, thereby producing substantial forces on the bar or counter apparatus supporting same.

U.S. Pat. 970,777 issued Sept. 20, 1910 to M. Ackerman discloses a folding seat having a seat portion pivotably secured to a vertical surface adjacent a marginal edge thereof. The other marginal edge carries a bar extending transverse to the aforementioned adjacent marginal edge to which one end of an arm is slideably affixed, the other end of the arm is pivotably supported by the vertical wall. Thus, the seat may be disposed upwardly and inwardly towards the vertical surface whereby the gliding portion on the outermost end of the arm descends downwardly towards the pivoting marginal edge of the seat, causing the surface of the seat to reside substantially parallel to the vertical surface. The Ackerman apparatus, though utilizing a supporting arm when the seat is disposed in a horizontal position, exerts a substantial force on the vertical surface due to the fact that such vertical surface not only provides vertical support for the seat and a weight rested thereon but due to torsional forces exerted on the uppermost regions of the vertical surface, adjacent the pivoting marginal edge of the seat.

U.S. Pat. No. 2,860,690 issued Nov. 18, 1958 to S. N. Small discloses a vertical rod mounted in a pair of sockets disposed secured to a vertical surface, such as the front of a bar or other tablelike apparatus. The rod carries a pair of arms pivotably secured thereto having at the free ends thereof another rod, also pivotably secured to the bars. A seat apparatus is pivoted to the uppermost end of the outwardly extending rod, whose lowermost end is permitted to reside on a portion of the surface of the floor adjacent the vertical structure supporting the apparatus. When it is desired to store the Small apparatus, the outwardly extending rod is pivoted adjacent the vertical surface and the seat portion is pivoted relative to the outwardly extending swingable rod. Though Small does not depend on cantilever forces or other high torsional forces exerted on the surface supporting same, due to the ground resting end of the outwardly extending rod, Small suffers the deficiency of having the swinging seat always disposed outwardly from the vertical surface supporting same. Thus, the Small apparatus is always in view and always requires a series of complex manual manipulation to simply dispose the apparatus into a stored position.

SUMMARY OF THE INVENTION

A primary object of the present invention is to provide a vanity storing step which may be disposed totally within a conventional vanity when not in use.

Another object of the present invention is to provide a step apparatus whose outwardly extending portion, when in a use position, are supported by a portion of the floor adjacent the vanity.

Still another object of the present invention is to provide a storable step which requires a simple manual manipulation to dispose the step from a use condition to a stored condition or from a stored position to a use position.

Yet another object of the present invention is to provide a storable vanity step which may be mounted to existing vanities, preferably of the variety having sink apparatus secured in the uppermost regions thereof.

A further object of the present invention is to provide a storing step device which children may be taught to use with relative ease.

Another object of the present invention is to provide a step apparatus which is totally safe to use and extremely stable, whilst providing a stair tread of substantial width at a preferred location relative to the front of a vanity carrying a sink.

Still another object of the present invention is to provide a stair tread which can be mounted to vanities whose base level varies, dependent upon the vanity construction.

Yet another object of the present invention is to provide a step apparatus, which when stored within the vanity may be supported therein without necessarily resting on pipe structures utilized to provide water, or to drain water from a sink.

A further object of the present invention is to provide a stair tread whose mounting and supporting portions are durable in construction, inexpensive to fabricate and easy to install in a wide variety of existing vanities carrying sinks.

Another object of the present invention is to provide a step apparatus which utilizes conventional material in construction, thereby minimizing the cost of manufacture and having a minimum number of moving parts thereby enhancing the useful lifetime of the apparatus.

Still another object of the present invention is to provide a stair apparatus which, by virtue of its simple operation and by virtue of its ability to carry the name of the user, creates a sense of ownership and reliance in a child utilizing same.

Heretofore, children found it very difficult to utilize sinks mounted at customary height above the surface of the floor adjacent thereto. Stools, boxes or chairs represented the only devices which permitted such individuals to conveniently reach the faucets and interior of the sink, while utilizing same. However, such movable devices often tipped over resulting in injury to the child. Furthermore, such devices were continually in the way during periods of non-use. Their weight and their size made it difficult for a child to position same in the proper location adjacent the front end of the vanity carrying the sink. Prior art devices, such as foldable seats and the like, each failed to serve the purpose as a stair tread so as to elevate the feet of the child in the correct location adjacent the front edge of the vanity. These prior art devices oft times, when stored, extended outwardly from the front of the vanity so as to present an unsightly appearance. Despite the fact that such superficially mounted apparatuses were not stored within the vanity, when in a non-use position, a number of complex and difficult manipulations were required to position the step of seat into a preferred use location.

The present invention recognizes these difficulties and solves same by utilizing an apparatus which is totally stored within the vanity when not in use. A simple unidirectional motion, imparted to one part of the apparatus, permits the present invention to have the stair tread portion thereof disposed in front of the vanity at an exact location, regardless of the height of the floor of the vanity. Such stair tread is exceptionally wide, thereby providing a secure ample supporting surface for the child. By mounting a portion of the present invention to the floor of the vanity and by permitting the leg portion of the present invention to reside resting on the outside floor area, the present invention is stable without applying destructive forces to the vanity. Personalizing exposed portions of the stair tread, easily viewed by the child when the stair tread is disposed stored within the vanity, creates the feeling within the child that the present invention is for his exclusive use, thereby encouraging him to utilize same rather than hanging from the edges of the top of the vanity, thereby exposing the child to injury. The present invention has an adjustment feature which permits the apparatus to be mounted to vanities having a floor located at various heights relative to the outside floor area, supporting the vanity. Thus, the present invention may be easily installed to vanities of diverse constructions. When the present invention is stored within the vanity or sink counter, an internal stop is provided such that the moving portions are supported in a preferred position so as not to interfere with or to come into contact with various pipes servicing the sink. Thus, the apparatus may be used indefinitely without creating damage or leaks.

These objects as well as other objects of the present invention, will become more readily apparent after reading the following description of the accompanying drawings.

DESCRIPTION OF THE PREFERRED EMBODIMENT

Figure 1:
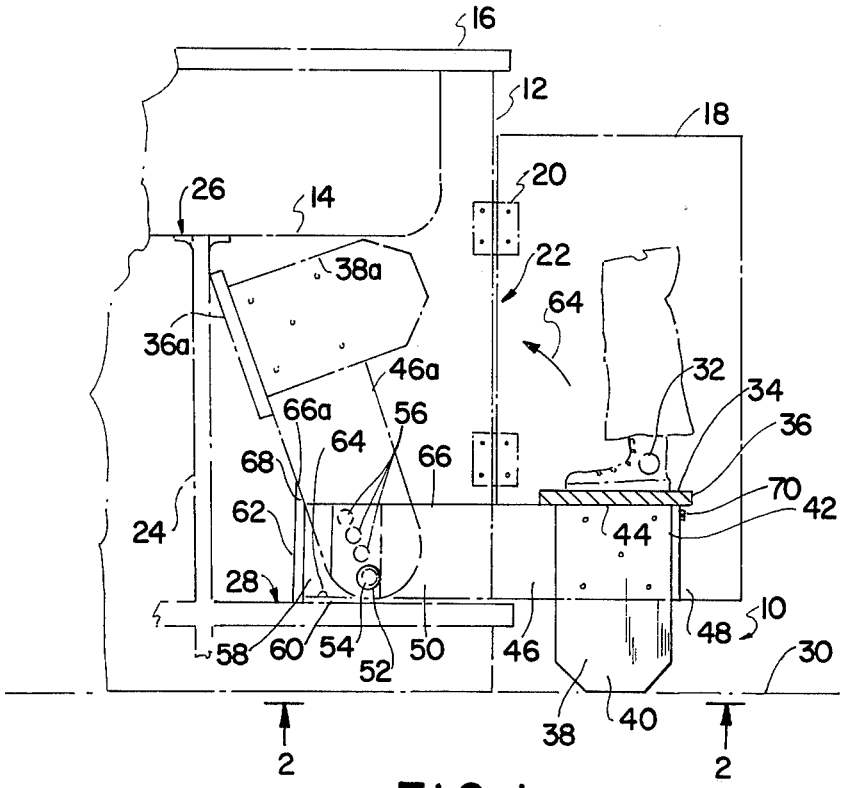
FIG. 1 is a side elevation view of the present invention, shown secured to a portion of a sink bearing vanity.

The structure and method of fabrication of the present invention is applicable to a elongated rectangular sheet-like stair tread. The undermost surfaces of the tread sheet have a pair of legs secured thereto, being disposed in spaced apart parallel relationship. A pair of arms are attached to the undermost surface of the stair tread and are secured to the legs, such that the arms have their longitudinal axis reside parallel to the supporting surface of the stair tread and are disposed in spaced apart parallel relationship. The free end of each arm is secured to a plate by a pivot bolt passing through a hole in the arm and through one of a plurality of holes in the plate, so as to permit the arms, stair tread and legs to be pivoted relative to the supporting plates. The hole utilized to carry the nut and bolt assembly, wherein the nut prevents the bolt from being accidentally dislodged from the hole carrying same, are selected so as to permit the arm to reside in a horizontal position when the free end of the legs are supported by the floor outside of the vanity regardless of the height at which the plates are positioned. Each of the plates are carried on the end of an L shaped assembly such that one of the legs of the assembly is secured to the interior floor of the vanity cabinet. The other leg of the L shaped assembly extends upwardly from the inner floor, having its uppermost marginal edge disposed closest to the lowermost floor-like surface of the sink carried by the vanity, thus, the overall relationship of the pair of plates and the L shaped assembly is similar to two ends and two adjacent sides of a rectangular solid, wherein one of such sides is disposed secured on top of the surface of the floor of the vanity and the other adjacent side extends upwardly therefrom. The end plates are disposed within the vanity so as to reside parallel to the interior side walls thereof. Each of the bolts are co-axially aligned with the other and reside extending along a line disposed parallel to the interior floor of the vanity. Such line may be positioned upwardly or downwardly dependent upon the hole selected within the plates. Thus, the arms are permitted to reside extending parallel to the floor supporting the vanity, at any selected height, dependent upon which hole, in the plate, that the bolts pass through. This permits the present invention to be utilized with a variety of constructions of vanities, having interior floor surfaces at diverse heights relative to the surface of the floor carrying same. The legs of the present invention, when pivoted upwardly and inwardly into the vanity, resides behind the front vertical surface of the vanity, so as to permit the door portions of the vanity, if any, to be closed thereby concealing the present invention from view. In this location, the stair tread lowermost surface may be viewed by peering into the vanity along a horizontal line extending below the uppermost surface of the vanity. The outermost edge of the stair tread is now disposed in an uppermost position and is supported in such uppermost position by having portions of the pair of arms reside in touching engagement with the uppermost marginal edges of the vertically extending leg of the L shaped assembly. Thus, the uppermost portion of the apparatus is positioned in a preferred location, thereby preventing the apparatus from engaging pipe portions of the sink device. Since the pivot acting bolts reside intermediate the vertically extending leg of the L shaped assembly and the front of the vanity, the arms, stair tread and legs of the present invention are disposed extending at an angle relative to the vertical so as to allow such portions of the invention to reside in a near vertical position which will not easily tilt forward.

A handle is secured to the undermost surface of the stair tread, permitting a user to simply apply a pulling force to the handle so as to permit the lowermost surface of the stair tread to be pulled forward and outwardly from the cabinet in a general downward direction so as to allow the free ends of the leg portions of the apparatus to contact the exterior. An oppositely applied force permits the apparatus to be restored within the vanity. When the stair tread is stored within the vanity, a personalized removable card, carried within a frame, such frame being secured to the underside surface of the stair tread, is easily seen by the user. Placing the childs name on the card enhances the relationship between the child and the apparatus, thereby permitting the child to become readily accustomed to utilizing the apparatus as his own.

Each of the components of the present invention, excepting the pivot acting bolts and nuts securing portions thereof, may be fabricated from any conventional material, such as wood, metal or plastic material, such as polypropylene. A plurality of holes disposed in the leg of the L shaped assembly, intended to be mounted on the interior floor surface of the vanity, may be utilized in conjunction with a set of wood screws, so as to permit the present invention to be easily mounted to the vanity. To adjust to the height of the floor of the vanity, the bolt and nut assemblies are repositioned to a selected set of the holes carried by the end plates. Personalizing the paper-like board completes the installation, the handle portion of the present invention having been preassembled to the undersurface of the stair tread.

New referring to the figures, and more particularly to the embodiment illustrated in FIG. 1 showing the present invention 10 shown being carried by vanity 12, generally shown in dotted lines. Sink portion 14 is disposed below countertop 16. Door 18 is carried by hinges 20 which permits a door 18 to expose an access port 22 to view. Pipe 24 extends downwardly from sink floor 26, in conventional fashion. Interior floor portion 28 is shown disposed above dotted lines 30, representing the surface of a floor carrying vanity 12. Present invention 10 is shown supporting foot 32 of a user on uppermost foot supporting surface 34 of a stair tread element 36. Leg element 38 is shown providing vertical support for stair tread element 36 by having end 40 thereof disposed touching dotted lines 30. End 42, of leg 38, is shown engaging the lowermost surface 44 of stair tread element 36. Arm 46 is shown having end 48 thereof secured to leg 38. End 50, of arm 46, is shown having hole 52 therein. Bolt 54 passes through hole 52 and may be positioned, if desired, so as to pass through any one of holes 56, shown in dotted lines. Holes 56 are carried in plate 58. Plate 58 is shown extending upwardly from surface 28 and is secured to horizontally disposed leg 60 and to a vertically disposed leg 62. Bolt 64 passes through horizontally disposed leg 60 and engages surface 28. When end 48 of arm 46 is moved in the direction of arrow 64, tread element 36 is positioned at a location depicted by dotted lines **36*a*. Point 66*a*, is shown engaging uppermost marginal edge 68, of vertical leg 62, when arm 46 is disposed in the position shown by dotted lines 46*a*. In this position, stair tread 36 is supported above and outwardly from vertically disposed leg 62 relative to bolt 54. Door 18 may then be closed. Handle 70 is shown mounted to surface 44 of tread element 36 in a convenient location when tread element 36 is in the location shown or when such tread element is in the position indicated by dotted lines 36*a***.

Figure 2:
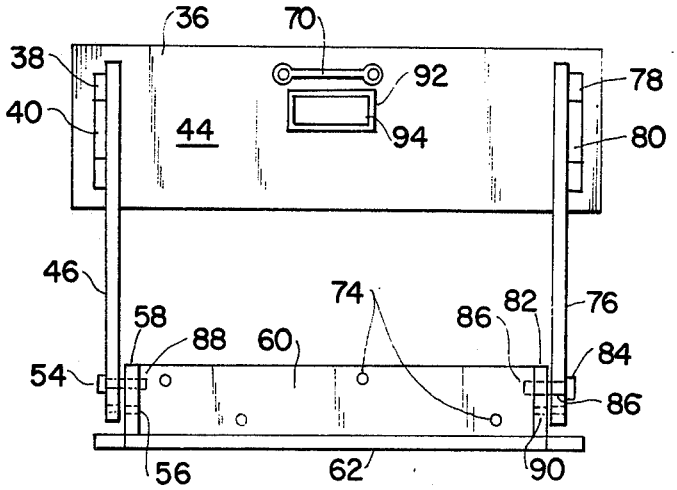
FIG. 2 is a bottom plan view of the present invention.

FIG. 2 illustrates horizontally disposed element 60 carrying a plurality of holes 74 therein in which bolt 64, shown in FIG. 1, may be utilized to pass therethrough. Arm 76 is shown disposed parallel to arm 46 and carries leg 78, equivalent in size and shape to leg 38 thereon. End 80, of leg 78, is provided thereon equivalent to end 40, of leg 38. Plate 82 is carried by legs 60 and 62, similar to plate 58 and is disposed in spaced apart parallel relationship with plate 58. Bolt 84 passes through hole 86, located in arm 76 and through a hole in plate 82, similar to bolt 54. Nuts 88 are utilized to retain bolts 54 and 84 in their preferred location. A hole, depicted by dotted lines 90, located in plate 82, is similar to holes 56, shown in FIG. 1. Such hole 90, may be utilized to have bolt 84 pass through, if desired. Frame 92 is shown disposed residing on surface 44, also carrying handle 70 thereon. indicia bearing card 94 is disposed within frame 92.

One of the advantages of the present invention is a vanity storing step which may be disposed totally within a conventional vanity when not in use.

Another advantage of the present invention is a step apparatus whose outwardly extending portion, when in a use position, are supported by a portion of the floor adjacent the vanity.

Still another advantage of the present invention is a storable step which requires a simple manual manipulation to dispose the step from a use condition to a stored condition or from a stored position to a use position.

Yet another advantage of the present invention a storable vanity step which may be mounted to existing vanities, preferably of the variety having sink apparatus secured in the uppermost regions thereof.

A further advantage of the present invention is a storing step device which children may be taught to use with relative ease.

Another advantage of the present invention is a step apparatus which is totally safe to use and extremely stable, whilst providing a stair tread of substantial width at a preferred location relative to the front of a vanity carrying a sink.

Still another advantage of the present invention is a stair tread which can be mounted to vanities whose base level varies, dependent upon the vanity construction.

Yet another advantage of the present invention is a step apparatus, which when stored within the vanity may be supported therein without necessarily resting on pipe structures utilized to provide water, or to drain water from a sink.

A further advantage of the present invention is a stair tread whose mounting and supporting portions are durable in construction, inexpensive to fabricate and easy to install in a wide variety of existing vanities carrying sinks.

Another advantage of the present invention is a step apparatus which utilizes conventional material in construction, thereby minimizing the cost of manufacture and having a minimum number of moving parts thereby enhancing the useful lifetime of the apparatus.

Still another advantage of the present invention is a stair apparatus which, by virtue of its simple operation and by virtue of its ability to carry the name of the user, creates a sense of ownership and reliance in a child utilizing same.

Thus, there is disclosed in the above description and in the drawings, an embodiment of the invention which fully and effectively accomplishes the objects thereof. However, it will become apparent to those skilled in the art, how to make variations and modifications to the instant invention. Therefore, this invention is to be limited, not by the specific disclosure herein, but only by the appending claims.

I claim:

1. A vanity storing step comprising a stair tread element, said tread element having a first lateral surface and a second lateral surface, at least one leg, said at least one leg having one end thereof fixedly secured to said first lateral surface, a pair of elongated arms, one end of each arm of said pair of elongated arms fixedly secured to said at least one leg, the longitudinal axes of said pair of elongated arms extending parallel to said first lateral surface and said second lateral surface and normal to said at least one leg, an elongated L-shaped structure, a pair of plates, said L-shaped structure having a first leg and a second leg, said pair of plates fixedly secured to said first leg and said second leg, said pair of plates being disposed in spaced apart parallel relationship, the other end of said each arm pivotably secured to said pair of plates along a common pivot axis whereby said pivot axis extends parallel to the longitudinal axis of said L-shaped structure, means to selectively locate said pivot axis along the lateral surfaces of said pair of plates.

2. The apparatus as claimed in claim 1 further comprising means to support said tread element upwardly and outwardly from said second leg when said second leg is disposed located in a vertical plane and having said first leg disposed located in a horizontal plane and having said second leg disposed in touching engagement with said pair of elongated arms.

3. The apparatus as claimed in claim 1 further comprising a handle, said handle fixedly secured to said first lateral surface of said tread element.

4. The apparatus as claimed in claim 1 further comprising a frame, said frame fixedly secured to said first lateral surface of said tread element, an indicia-carrying card, said indicia-carrying card being disposed removeably secured within said frame.

5. The apparatus as claimed in claim 1 wherein said means to selectively position comprises a plurality of holes being disposed in each of said pair of plates, said plurality being located in spaced apart relationship, a hole being disposed located in said other end of said each arm, a bolt, said bolt passing through said hole in said other end of said each arm and through one of said plurality of holes, wherein said bolt may be repositioned passing through another hole of said plurality of holes thereby locating said pivot axis at a preferred location relative to a lateral surface of said first leg.

6. The apparatus as claimed in claim 1 further comprising an additional plurality of holes located in said first leg element.

7. The apparatus as claimed in claim 1 further comprising another leg, said another leg being disposed having one end thereof fixedly secured to said first lateral surface of said tread element, said another leg being disposed in spaced apart parallel relationship with said at least one leg.

8. The apparatus as claimed in claim 7 wherein said at least one leg is fixedly secured to said one end of one arm of said pair of arms, said another leg fixedly secured to said one end of the other arm of said pair of arms.

9. The apparatus as claimed in claim 1 wherein said first leg of said L-shaped structure is disposed fixedly secured to the upper lateral surface of an interior floor-like element of a sink carrying vanity, whereby the length of said pair of arms is configured to support said second lateral surface of said tread element in a horizontal plane when the free end of said at least one leg is disposed in touching engagement to a horizontal supporting surface providing vertical support for said vanity and whereby said at least one leg and said tread element and said L - shaped structure are carried within said vanity when said tread element is pivoted upwardly and inwardly into said vanity so as to be totally confined within the interior cavity of said vanity.

10. The apparatus as claimed in claim 1 wherein said at least one leg comprises an elongated rigid sheet.

* * * * *